US005116156A

United States Patent [19]

Landi

[11] Patent Number: 5,116,156

[45] Date of Patent: May 26, 1992

[54] ROLLER-TYPE MATERIAL APPLICATOR

[76] Inventor: Joseph V. Landi, 7-11 Hopper Ave., Fair Lawn, N.J. 07410

[21] Appl. No.: 558,567

[22] Filed: Jul. 27, 1990

[51] Int. Cl.[5] ..... B05C 17/025

[52] U.S. Cl. ..... 401/208; 401/213

[58] Field of Search ..... 401/208, 213, 209, 214, 401/215

[56] References Cited

U.S. PATENT DOCUMENTS

| | | | |
|---|---|---|---|
| 1,485,181 | 2/1924 | Grund | 401/214 |
| 2,883,690 | 4/1959 | Holler | 401/213 |
| 2,912,708 | 11/1959 | Schaich | 401/213 |
| 3,055,041 | 9/1962 | Schaich | 401/213 |
| 3,095,598 | 7/1963 | Gonnella | 401/213 |
| 3,134,131 | 5/1964 | Thomas | 401/208 |
| 3,166,779 | 1/1965 | Miles | 401/213 |
| 3,235,900 | 2/1966 | Klassen | 401/215 X |
| 3,263,265 | 8/1966 | Judson | 401/208 X |
| 3,284,839 | 11/1966 | Cook | 401/208 X |
| 4,168,123 | 9/1979 | Fillmore | 401/213 |
| 4,723,860 | 2/1988 | Giblin | 401/208 |
| 4,984,921 | 1/1991 | Fattori | 401/208 |

FOREIGN PATENT DOCUMENTS

| | | | |
|---|---|---|---|
| 405901 | 2/1934 | United Kingdom | 401/215 |

*Primary Examiner*—Danton D. DeMille

*Attorney, Agent, or Firm*—Lerner, David, Littenberg, Krumholz & Mentlik

[57] ABSTRACT

A roller-type material applicator having a roller element for topical application of various materials is disclosed. The roller element is separated from a material containing portion of the applicator by a discharge opening which is surrounded by a raised sealing rib. The application of a closure cap applies a compressive force to the roller element which is constructed of deformable-resilient material so as to be deformed into sealing engagement with the sealing rib. Upon removal of the closure cap, the roller element assumes its original shape by virtue of its resilient nature to allow discharge of the material contents of the applicator for application by the roller element.

16 Claims, 2 Drawing Sheets

ROLLER-TYPE MATERIAL APPLICATOR

BACKGROUND OF THE INVENTION

The present invention relates in general to a dispensing container, and more particularly, to a roller-type product dispensing applicator having a sealable material containing portion from which the material to be applied is discharged.

Roller-type applicators are well known in the art and have enjoyed wide commercial use for application of a variety of products. These products are not limited to, but may include adhesives, paints, stain removers, topical medicines and cosmetics. The latter category includes colognes, after-shave lotions, body lotions, sunscreens, suntan formulas, deodorants, antiperspirant and depilatories. The roller-type applicator has been particularly successful in the application to the skin of deodorants and antiperspirant. This success is a result of their convenient use and their association with high efficiency due at least, in part, to their ability to deposit a concentrated dose of active material precisely where it will have the most effect.

Despite the success of roller-type applicators, certain types of product formulations lend themselves more readily to one kind of dispensing system than another. For example, roller-type applicators function well with products having a uniform creamy or oily consistency, while pressurized aerosol dispensers have provided an effective way to spray products in the form of relatively unstable liquid-solid suspensions. Some of these suspension-type products, such as antiperspirant including certain aluminum or zirconium salts in a volatile silicon carrier, present special sealing problems in dispensing with an applicator which includes a roller element in a socket. If the clearances are kept relatively close, as is customary, the roller element is likely to stick or bind as a result of the solids becoming trapped on the bearing surfaces. On the other hand, if the clearances are sufficiently large to accommodate such non-greasy suspension-type products, the sticking can be reduced, but leakage of the contained carrier becomes a significant problem when, as often happens, the applicator is stored in any orientation other than upright.

It has also been found desirable in numerous applications to employ roller elements which vary from circular in cross-section to elongated, oblong or elliptical in order to provide a wide contact area for applying deodorants, antiperspirant and the like. However, the problem of adequate sealing of such a roller element in its seat and the prevention of sticking for certain kinds of formulations become even more aggravated with these bigger roller elements.

One roller-type applicator designed to overcome the above-described disadvantages is known from Giblin et al., U.S. Pat. No. 4,723,860. Giblin et al. provides a dispensing package for delivery of liquids such as antiperspirant using an oval shaped roller. In addition to the roller being rotatably mounted within a socket, the roller is displaceable along a vertical axis by including pegged ends received within slots provided within spaced apart support arms. The roller is biased upwardly by a central spring assembly which includes a valve and seat arrangement for a discharged opening for the contents of the dispensing package. In use, when the roller is pressed against a treating surface, e.g., skin, the roller pushes down upon the spring biased valve and seat assembly thereby permitting the contained material to exit the dispensing package and to be spread by the roller onto the treatment surfaces.

Despite the positive attributes of the dispensing package constructed in accordance with Giblin et al., such package has a number of notable disadvantages. In particular, its construction to include a spring assembly and a valve and seat arrangement results in the package being relatively complicated to manufacture and assemble, as well as resulting in additional costs. Considering that these dispensing packages are not reusable, and are merely designed for selling the contained product, any additional costs in construction of these dispensing packages is undesirable. Further, use of the Giblin et al. dispensing package requires the application of sufficient force by the user to overcome the closing force of the spring assembly. Where these dispensing packages are being used for application of products to the skin, such as deodorants and antiperspirant, the application of such force to the skin is considered undesirable and deattracts from the usability of these packages.

There is also known from Gonnella et al., U.S. Pat. No. 3,095,598 a dispensing package which is constructed to include a roller of glass or like rigid material arranged for sealing engagement with an underlying resilient seal element having a passageway in communication with the material to be dispensed. When the cap is fitted over the roller and secured to the dispensing package, the roller is forced downwardly into sealing engagement with the resilient seal element to prevent discharge of the contained material. However, when the cap is removed, it is necessary that the roller be elevated from its sealing position to allow discharge of the material. To this end, there is provided flexible projections extending within the cavity receiving the roller which serve to elevate the roller upon removal of the cap.

The dispensing package of Gonnella et al., although providing an arrangement which simplifies the sealing arrangement for the package, also suffers from a number of disadvantages associated with its construction. For example, due to the flexible nature of the projections, such projections must be constructed from a material different from the remaining material forming the dispensing package. As a consequence, the projections must be formed separate and apart from the fabrication process for the dispensing package which is typically injection molding and the like. In addition, these projections due to their flexible nature are subject to failure by breakage or loss of resiliency which will prevent the roller from being elevated from its sealed position. As a result, the contained material cannot be discharged from the dispensing package rendering the package unusable even though additional material may exist.

There is further known from Fillmore et al., U.S. Pat. No. 4,168,128 a dispensing package which provides a double seal to prevent inadvertent dispensing of the contained contents. A primary seal is formed between a rigid dispensing roller and its receiving fitment of resilient material upon securing of the closure cap to a rigid housing. The primary seal is created by engagement of the fitment with the dispensing roller in the region of a diaphragm portion of the fitment which has an aperture through which the material to be dispensed is discharged. The closure cap also includes a quantity of resilient material, such as foamed polymer, positioned to contact the dispensing roller and the receiving fitment to form a secondary seal to prevent leakage of the contained material when the closure cap is placed into engagement with the container. This dispensing package although having a number of attributes is also undesirable as it requires a separate receiving fitment from the housing due to the different construction materials employed, as well as requiring the provision of a foamed polymer insert. This requirement for multiple components of the dispensing package which must be separately manufactured and assembled adds undesirably to the manufacturing cost of an item which is otherwise intended to be nonreusable and disposable.

Despite the existence of the dispensing packages known from Giblin et al., Gonnella et al. and Fillmore et al., there remains unknown a roller-type material applicator which overcomes the above described disadvantages while remaining simple in construction, relatively easy to manufacture and relatively inexpensive to construct. It is therefore an object of the present invention to overcome the disadvantages associated with roller-type dispensing packages as heretofore known.

SUMMARY OF THE INVENTION

In accordance with one embodiment of the present invention, there is provided an applicator constructed of a housing having a material containing portion and an opening through which material is discharged, a roller element of resilient material arranged within the housing for application of the material, a seal element in operative association with the opening and the roller element, and a cap removable securable to the housing overlying the roller element, the cap when secured to the housing deforming the roller element into sealing engagement with the seal element to prevent discharge of material by the applicator.

In accordance with another embodiment of the present invention, there is provided an applicator constructed of a housing having a material containing portion and a roller element receiving portion, the housing having an opening providing material communication between the material containing portion and the roller element receiving portion, a roller element of resilient material rotatable received within the roller element receiving portion for applying material discharged through the opening, a seal element of rigid material surrounding the opening underlying the roller element and a cap removable securable to the housing overlying the roller element, the cap when secured to the housing deforming the roller element into sealing engagement with the seal element to prevent discharge of material by the applicator and when removed from the housing permitting discharge of material through the opening for application by the roller element.

In accordance with another embodiment of the present invention, there is provided an applicator constructed of a housing having a material containing portion and a roller element receiving portion separated therefrom, the housing having an opening arranged within a portion of the housing separating the material containing portion from the roller element receiving portion, a roller element of deformable-resilient material rotatably received within the element receiving portion for applying material discharged through the opening, a seal element of rigid material provided on the portion of the housing separating the material containing portion and the roller element receiving portion, the seal element arranged surrounding the opening underlying and spaced from the roller element to permit discharge of the material through the opening, a pair of spaced apart supports within the roller element receiving portion for supporting the roller element in spaced relationship with the seal element and that portion of the housing forming the roller element receiving portion, and a cap removably securable to the housing overlying the roller element, the cap when secured to the housing deforming the roller element into sealing engagement with the seal element to prevent discharge of material by the applicator and when removed from the housing permitting discharge of material through the opening for application by the roller element.

BRIEF DESCRIPTION OF THE DRAWINGS

The above description, as well as further objects, features and advantages of the present invention will be more fully understood with reference to the following detailed description of a roller-type material applicator, when taken in conjunction with the accompanying drawings, wherein.

DETAILED DESCRIPTION

Figure 1:
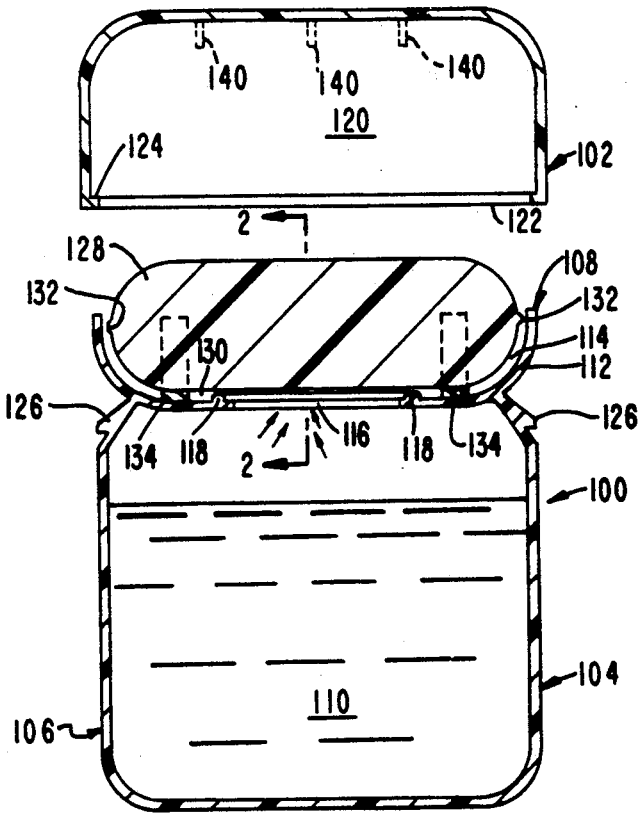
FIG. 1 is a front elevational view, in cross-section, of a roller-type material applicator constructed to include a cap, a material containing housing and a roller element for application of the contained material, which applicator is constructed in accordance with one embodiment of the present invention.

Referring now to the drawings, wherein like reference numerals represent like elements, there is shown in FIG. 1 a roller-type material applicator constructed in accordance with one embodiment of the present invention and designated generally by reference numeral 100. The applicator 100 is constructed generally from a cap 102 and a housing 104 which includes a material containing portion 106 and a roller element receiving portion 108. The material containing portion 106 provides a storage area or reservoir for material 110 to be dispensed by the applicator 100. As previously noted, a wide variety of materials 110 may be utilized with the applicator 100. These materials 110 are not limited to, but may include adhesives, paints, stain removers, topical medicants and cosmetics, such as colognes, aftershave lotions, body lotions, sunscreens, depilatories, suntan formulas, deodorants and antiperspirant. Of particular significance is the use of the applicator 100 for the delivery of liquid deodorants or antiperspirants having a uniform creamy or oily consistency in topical applications. However, it is to be understood that the applicator 100 of the present invention may be utilized for dispensing other materials 110 as, for example, noted hereinabove.

The roller element receiving portion 108 is formed from a cup-shaped member 112 providing a roller element receiving cavity 114 and having a centrally located discharge opening 116 in material communication with the interior of the material containing portion 106. A seal element is formed from a portion of the cup-shaped member 112 in the form of a raised rib 118 encircling the discharge opening 116. The cap 102 includes a hollow interior 120 and an open mouth 122 circumscribed inwardly by a projecting rib 124. The rib 124 is designed to releasably interlock with a shoulder 126 projecting outwardly from the material containing portion 106 in a known manner.

As thus far described, the cap 102 and housing 104 can be integrally constructed from any suitable rigid plastic material using known process techniques such as injection molding injection blow molding and the like. By way of example, one suitable rigid plastic material includes high density polyethylene, although other such materials are also suitable for use with the present invention. In this regard, the rigid plastic material should be suitably chosen to be compatible with material 110 to be dispensed. It is also to be understood that the raised rib 118 forming the seal element could also be integrally formed during the fabrication of the housing 104 and cup-shaped member 112.

Rotatably received within the roller element receiving cavity 114 is a roller element 128 which may be constructed into a variety of shapes from a variety of suitable materials. For example, the roller element 128 may include such shapes as oval, elliptical, spherical, cylindrical and the like. It is contemplated that a roller element 128 having a football shape will be preferred. In particular, by way of example, the roller element can have a diameter of 1.0 inches, a length of 1.8 inches, an end radius of 0.25 inches and a circumferential radius of 1.226 inches. In another example, the roller element can have a diameter of 0.788 inches, a length of 1.791 inches, an end radius of 0.25 inches and a circumferential radius of 1.785 inches.

In this regard, the roller element receiving cavity 114 by virtue of the cup-shaped member 112 will be constructed to have a shape conforming to the shape of the roller element 128. The roller element 128 is preferably of solid construction, however, it may be porous or provided with one or more internal cavities to affect its resiliency and deformation characteristics if so desired. In accordance with the present invention, the roller element 128 is formed from any one of a number of resilient materials which are at least partially deformable and which will return to their original shape upon removal of the deforming force. To this end, a number of resilient synthetic materials may be chosen for the roller element 128. For example, one such material includes a composition of 80% Shell Kraton G-2706 synthetic styrene rubber and 20% Dow LDPE No. 722 low density polyethylene. Another composition for the roller element 128 includes 60% Shell Kraton G-2706 synthetic styrene rubber and 40% Dow LDPE No. 722 low density polyethylene.

In addition to these compositions, it is to be understood that other resilient synthetic materials, as well as naturally occurring resilient materials are also suitable for use in construction of the roller element 128. For example, such materials as thermoplastic rubber, vinyl, styrene block copolymers, butyl rubber, elastomers, neoprene rubber, ethylene vinyl acetate, natural rubber and the like. In selecting the composition for the roller element 128, it is also to be noted that compatibility with the material 110 being dispensed should be taken into consideration as previously noted with respect to the material of construction for the housing 104.

As should now be apparent, one property of the roller element 128 is its resilient nature and ability to be deformed under a compressive force, while returning to its original shape upon removal of the deforming force. The above-noted compositions are suitable for this purpose. In selecting the composition for the roller element 128, one useful guideline is hardness of the composition as measured, for example, by a durometer. For example, it is contemplated that compositions for the roller element 128 having a hardness in the range of about 45 to 80 Shore A will possess the necessary resiliency to allow deformation while returning to its original shape upon removal of the deforming force. Thus, it should be understood that the specific hardness of the composition for the roller element 128 will, in part, be determined by the specific nature of the composition itself. In this regard, based on the above specific compositions which include Shell Kraton G-2706 synthetic styrene rubber and Dow LDPE No. 722 low density polyethylene, a hardness of about 65 Shore A is preferred.

The roller element 128 is rotatably received within the roller element receiving cavity 114 for rotation about its longitudinal axis. As noted, the shape of the roller element 128 corresponds to the shape of the roller element receiving cavity 114. The exterior surface of the roller element 128 is maintained in spaced apart relationship with the interior surface of the cup-shaped member 112 to provide a material passageway 130 therebetween. The passageway 130 enables material 110 which is discharged through opening 116 to flow circumferentially about the roller element 128 for application of the material during use of the applicator 100.

In maintaining the passageway 130, the roller element 128 is provided with a pair of nipples 132 which extend outwardly from the surface thereof to prevent shifting of the roller element longitudinally within the roller element receiving cavity 114. In addition, there is provided a pair of spaced apart U-shaped bearing support arms 134 received within the roller element receiving cavity 114 for rotationally supporting the roller element 128. As shown, the thickness of the bearing support arms 134 is greater than the height of raised rib 118 to prevent engagement of the roller element 128 with the rib during use of the applicator 100 as to be described hereinafter. The bearing support arms 134 can be constructed from any suitable rigid plastic material, such as the same material used for the construction of the housing 104. In this regard, although the bearing support arms 134 have been described as separate elements from the housing 104, it is to be understood that the bearing support arms can be integrally formed with the housing and specifically with the cup-shaped member 112 if so desired. As will be clear from a further description, the bearing support arms 134 in addition to supporting the roller element 128 in spaced apart relationship from raised rib 118 to maintain passageway 130, the support arms function as deformation and bearing supports for the roller element.

Figure 3:
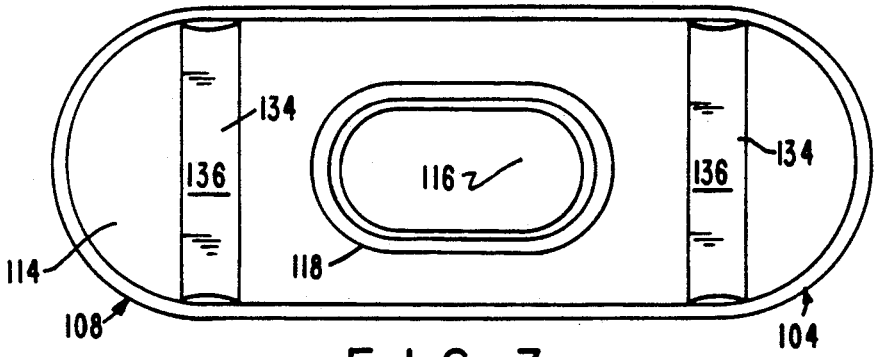
FIG. 3 is a top plan view of the roller element receiving cavity of the roller-type material applicator showing a pair of spaced apart roller element bearing support arms and a continuous seal element surrounding a material discharge opening in accordance with the present invention.

As shown in FIG. 3, the bearing support arms 134 are spaced apart on either side of the discharge opening 116. Each of the bearing support arms 134 is provided with a smooth rolling surface 136 for rotationally supporting the roller element 128. The raised rib 118 is positioned between the bearing support arms 134 totally surrounding the discharge opening 116. Although the raised rib 118 is shown as having an oval shape, it is to be understood that other shapes for the rib may be used in accordance with the present invention. For example, the raised rib 118 may have the shape of a circle, ellipse, oval, square and the like. In addition, the upper surface of the raised rib 118 may have a variety of profiles, for example, rounded, square, pointed, and the like. Although the bearing support arms 134 have been described as a unitary element, it is to be understood that such arms may be formed as segmented pieces or may be provided with slots or holes (not shown) arranged transversely therethrough. The slots or holes will function to enable the discharged material 110 to pass through the bearing support arms 134 to enhance coverage of the roller element 128 at its longitudinal ends. However, due to the rolling action of the roller element 128, the material 110 is uniformly coated onto the exterior surface of the roller element in the absence of such holes or slots.

Figure 2:
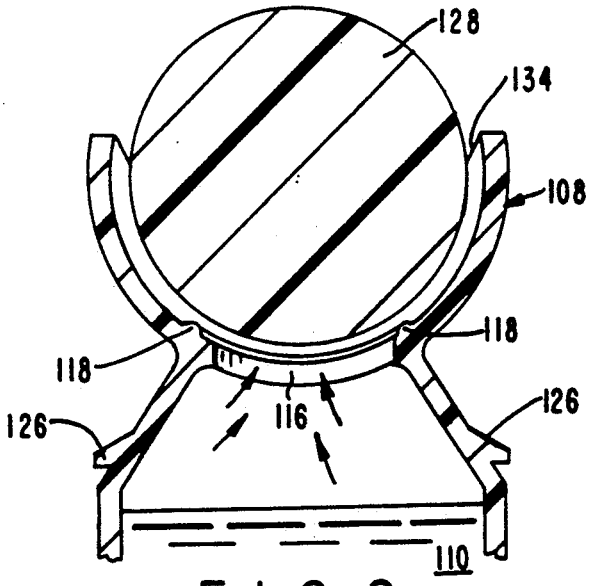
FIG. 2 is a side elevational view, in cross-section, of a portion of the roller-type material applicator shown in FIG. 1, and taken along line 2—2 therein and showing the supported arrangement of the roller element in a roller element receiving cavity of the housing.

There will now be described the use of the applicator 100 in applying material 110 and preventing its discharge through opening 116 during storage in accordance with the present invention. Referring to FIGS. 1 and 2, the applicator 100 is shown with cap 102 removed and the upper surface of the roller element 128 exposed by extending beyond the limits of the roller element receiving portion 108. The roller element 128 is supported within the roller element receiving cavity 114 by the bearing support arms 134 to maintain passageway 130 in material communication with the interior of the material containing portion 106 of the housing 104. The exterior surface of the roller element 128 is maintained spaced apart from the raised rib 118 to allow passage of material 110 from within the material containing portion 106 through passageway 130 and onto the exterior surface of the roller element 128. The applicator 100 may be used in a conventional manner to apply a coating of the material 110 by means of the roller element 128 to the desired area, for example, the underarms of the user.

When not in use, it is desired to seal the discharge opening 116 to prevent the material 110 contained within the material receiving portion 106 from being dispensed into the roller element receiving cavity 114. The sealing of the discharge opening 116 is particularly desirable during shipment of the applicator 100 from the manufacturer to the ultimate user through normal channels of trade. However, it is also desirable to be able to seal the discharge opening 116 by the user to prevent possible evaporation of material 110 and leakage that might occur during transport in one's suitcase or the like when traveling. To this end, reference is made to FIGS. 4 and 5 where a description of sealing the discharge opening 116 will now be described.

Figure 4:
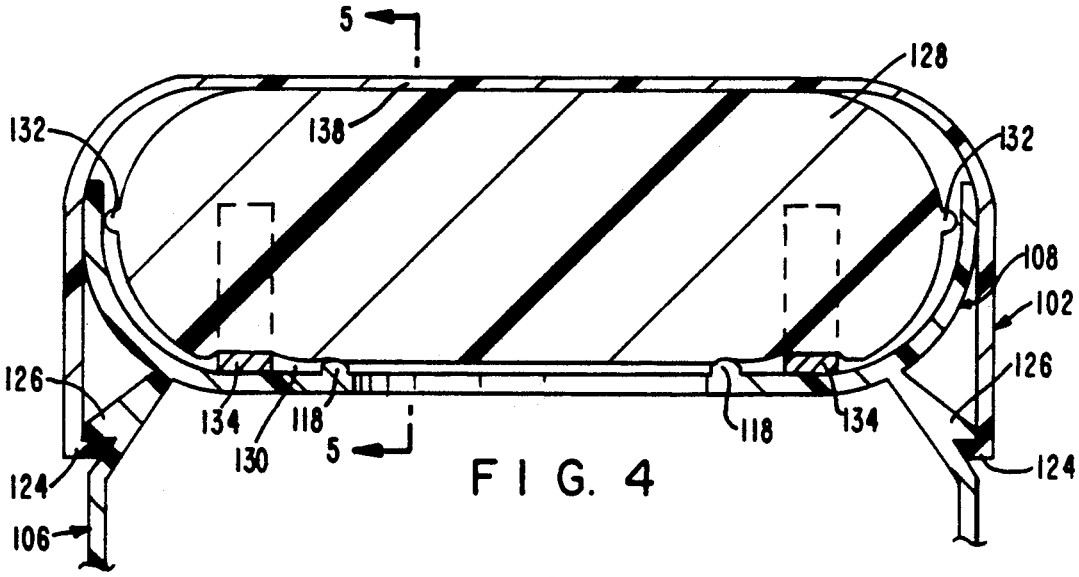
FIG. 4 is a partial front elevational view, in cross-section, showing a portion of an assembled roller-type material applicator with the roller element in sealing engagement with the seal element to prevent material discharge through the discharge opening in accordance with the present invention.
Figure 5:
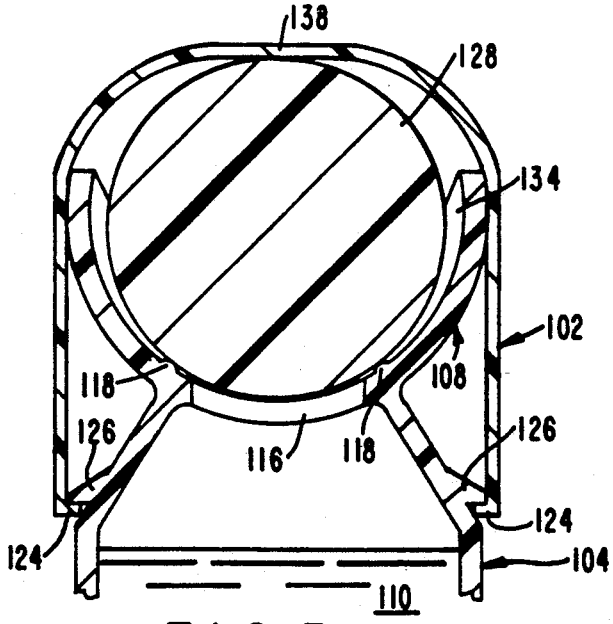
FIG. 5 is a partial side elevational view, in cross-section, showing a portion of an assembled roller-type material applicator in accordance with the present invention, and taken along line 5—5 in FIG. 4.

The discharge opening 116 is sealed by simply securing the cap 102 to the housing 104 upon engagement of rib 124 with the shoulder 126. The cap 102 is sized so that its upper central portion 138 exerts a downward compressive force longitudinally along the top of the roller element 128. The force applied by cap 102 is sufficient to cause partial deformation of the roller element 128 in the region between the bearing support arms 134 as best shown in FIG. 4. The deformation of the roller element 128 about the bearing support arms 134 causes the intervening portion of the roller element to be deformed downwardly into sealing engagement with raised rib 118 which surrounds the discharge opening 116. As a result, the external surface of the lower portion of the roller element 128 is maintained in sealing engagement with raised rib 118 to provide an effective seal thereat. The seal, as thus far created, will be maintained as long as the cap 102 is secured to the housing 104. As such, the material passageway 130 has been effectively sealed from the discharge opening 116 to prevent dispensing of the material 110 from within the material containing portion 106.

The ability of the roller element 128 to create a seal with the raised rib 118 is based upon the resilient nature of the roller element and its ability to be deformed by application of a sufficient force when the cap 102 is secured to the housing 104. It should be apparent that when other shapes for the roller element 128 are employed, sealing engagement with the raised rib 118 will be achieved in a similar manner upon deformation of the roller element. For example, where the roller element 118 is in the shape of a sphere, the deformation force applied by cap 102 will cause the roller element to assume a spheroid shape so as to sealing engage the raised rib 118. To enhance the application of the compressive force by cap 102, the interior of the cap may be provided with a pair of spaced apart lugs 140, as shown in dotted lines in FIG. 1, so as to exert localized compressive force to the roller element 128.

Upon removal of the cap 102, the roller element 128, due to its resilient nature, will return to its original undeformed shape to open material passageway 130 into material communication with discharge opening 116 to enable application of the material 110 upon discharge from the material containing portion 106. As a result of the resilient nature of the roller element 128, the discharge opening 116 may be repeatedly sealed by application of the cap 102, while allowing use of the applicator 100 upon removal of the cap. From the foregoing, it will be seen that the present invention is one well adapted to attain all of the ends and objects hereinabove set forth together with other advantages which are obvious and which are inherent to the disclosed roller-type material applicator 100.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An applicator comprising a housing having a material containing portion and an opening through which material is discharged, an oval shaped roller element of resilient material having an uninterrupted surface and a long axis arranged within said housing for application of a material upon rotation of said roller element about said long axis, a seal element comprising a portion of said housing in operative association with said opening, and said roller element, said seal element comprising a raised rib immediately surrounding said opening and a cap removably securable to said housing overlying said roller element, said cap when secured to said housing causing at least a portion of said roller element to deform upon engagement with said seal element to provide a seal thereat to prevent discharge of material by said applicator.

2. The applicator of claim 1, wherein said raised rib is constructed from rigid synthetic material.

3. An applicator comprising a housing having a material containing portion and an opening through which material is discharged, an oval shaped roller element of resilient material having an uninterrupted surface and a long axis arranged within said housing for application of a material upon a rotation of said roller element about said long axis, a cup-shaped member forming a receiving cavity for said roller element, said opening arranged within said member, a seal element in operative association with said opening and said roller element, said seal element comprising a raised rib immediately surrounding said opening integrally formed with said cup-shaped member, and a cap removably securable to said housing overlying said roller element, said cap when secured to said housing causing at least a portion of said roller element to deform upon engagement with said seal element to provide a seal thereat to prevent discharge of material by said applicator.

4. The applicator of claim 3, further including a pair of spaced apart U-shaped arms for rotationally supporting said roller element on either side of said opening.

5. The applicator of claim 3, wherein said roller element is constructed of resilient synthetic material having a hardness in the range of about 40 to 80 Shore A.

6. The applicator of claim 3, further including a pair of spaced apart U-shaped arms for rotationally supporting said roller element on either side of said opening integrally formed with said cup-shaped member.

7. The applicator of claim 3, wherein said seal element comprises a portion of said housing.

8. An applicator comprising a housing having a material containing portion and a roller element receiving portion, said housing having an oval shaped opening arranged within a portion of said roller element receiving portion providing fluid communication with said material containing portion of said housing, an oval shaped roller element of deformable-resilient material having an uninterrupted surface and a long axis, said roller element is rotatably received about said long axis within said element receiving portion for applying material discharged through said opening, said roller element comprising resilient synthetic material having a hardness in the range of about 40 to 80 Shore A, a seal element comprising a raised rib of rigid material provided on said portion of said housing separating said material containing portion and said roller element receiving portion, said seal element arranged immediately surrounding said opening underlying and spaced from said roller element to permit discharge of material through said opening, a pair of spaced apart supports arranged outwardly of said seal element within said roller element receiving portion for supporting said roller element in spaced relationship with said seal element and that portion of said housing forming said roller element receiving portion, and a cap removably securable to said housing overlying said roller element, said cap when secured to said housing deforming said roller element into sealing engagement with said seal element to prevent discharge of material by said applicator and when removed from said housing permitting discharge of material through said opening for application by said roller element.

9. The applicator of claim 8, wherein said raised rib and said spaced apart supports are integrally formed with said roller element receiving portion.

10. An applicator comprising a housing having a material containing portion and a roller element receiving cavity, said housing having an oval shaped opening providing material communication between said material containing portion and said roller element receiving cavity, an oval shaped roller element of resilient material having an uninterrupted surface and a long axis rotatable received about said long axis within said roller element receiving cavity for applying material discharged through said opening, a seal element of rigid material immediately surrounding said opening underlying said roller element, and a cap removably securable to said housing overlying said roller element, said cap when secured to said housing deforming said roller element into sealing engagement with said seal element to prevent discharge of material by said applicator and when removed from said housing permitting discharge of material through said opening for application by said roller element.

11. The applicator of claim 10, wherein said seal element comprises a raised rib.

12. The applicator of claim 11, wherein said raised rib is constructed from rigid synthetic material.

13. The applicator of claim 10, further including a pair of spaced apart U-shaped arms for rotationally supporting said roller element on either side of said opening within said roller element receiving cavity.

14. The applicator of claim 10, wherein said roller element is constructed of resilient synthetic material having a hardness in the range of about 40 to 80 Shore A.

15. The applicator of claim 10, wherein said seal element comprises a raised rib integrally formed with said roller element receiving cavity.

16. The applicator of claim 15, further including a pair of spaced apart U-shaped arms for rotationally supporting said roller element on either side of said opening integrally formed with said roller element receiving cavity.

* * * * *